United States Patent [19]

Otani et al.

[11] 4,214,802

[45] Jul. 29, 1980

[54] WATERPROOF ELECTRIC CONNECTOR

[75] Inventors: Syuichi Otani, Tokyo; Shinichi Kato, Fujisawa, both of Japan

[73] Assignee: Nissan Motor Company, Limited, Yokohama, Japan

[21] Appl. No.: 3,065

[22] Filed: Jan. 12, 1979

[30] Foreign Application Priority Data

Jan. 20, 1978 [JP] Japan ..... 53/5514

[51] Int. Cl.[2] ..... H01R 13/48; H01R 13/54

[52] U.S. Cl. ..... 339/60 M; 339/63 M; 339/91 R; 339/94 M

[58] Field of Search ..... 339/59–63, 339/94, 196, 206, 91 R

[56] References Cited

U.S. PATENT DOCUMENTS

| | | | |
|---|---|---|---|
| 2,903,668 | 9/1959 | Cornell, Jr. | 339/63 M |
| 3,171,887 | 3/1965 | Cross et al. | 339/94 M |
| 3,327,282 | 6/1967 | Krolak | 339/63 M |
| 3,818,420 | 6/1974 | Barr | 339/94 R |
| 4,029,386 | 6/1977 | Krantz, Jr. et al. | 339/143 R |
| 4,116,521 | 9/1978 | Herrmann, Jr. | 339/60 R |

*Primary Examiner*—Neil Abrams

*Attorney, Agent, or Firm*—Schwartz, Jeffery, Schwaab, Mack, Blumenthal & Koch

[57] ABSTRACT

A waterproof terminal pin holding block comprising a housing having a chamber which is closed at one end by a partition wall and open at the other end, the partition wall being formed with at least one opening; a plug member of resilient elastomeric material sealingly disposed in the chamber and having a through hole which is aligned with the opening of the partition wall upon final fitting of the plug member in the housing; a contact pin sealingly disposed in the through hole of the plug member in a manner that at least one section of the contact pin is placed in the opening; and locking means for locking the plug member and the housing together.

9 Claims, 9 Drawing Figures

WATERPROOF ELECTRIC CONNECTOR

BACKGROUND OF THE INVENTION

The present invention relates in general to an electrical connector comprising a male pin holding block and a female pin holding block which are coupled together to provide electrical connection therebetween, and more particularly this invention is concerned with a so-called waterproof electrical connector.

SUMMARY OF THE INVENTION

It is an object of the present invention to provide a new and improved waterproof electric connector in which the coupling of the male and female pin holding blocks is facilitated.

It is another object of the present invention to provide a waterproof electric connector in which contact pins of the blocks are tightly held in the corresponding housings.

It is still another object of the present invention to provide a waterproof electric connector in which the male and female contact pins of the blocks are protected from being exposed to the surrounding air when the male and female pin holding blocks are coupled together thereby preventing the contact pins from rusting.

It is a further object of the present invention to provide a waterproof electric connector which is compact and simple in construction.

According to the present invention, there is provided a waterproof electric connector comprising a pair of terminal pin holding blocks which can be coupled together to provide electric connection therebetween, each of the blocks, comprising a housing having a chamber which is closed at one end by a partition wall and open at the other end, the partition wall being formed with at least one opening; a plug member of resilient elastomeric material sealingly but removably disposed in the chamber of the housing, the plug member being formed with a through hole which is aligned with the opening upon final fitting of the plug member in the chamber; a contact pin sealingly but removably disposed in the through hole of the plug member in a manner that at least a section of the contact pin is placed in the opening of the partition wall, the contact pin having at a section thereof a mating portion matable with a mating portion of a contact pin of the paired terminal pin holding block; locking means for locking the plug member and the housing together, the locking means including a flange portion formed about the housing at the open end of the same, and a folded back portion formed about one end of the plug member, the folded back portion enclosing the flange portion upon final fitting of the plug member in the housing thereby to accomplish locking engagement between the plug member and the housing; coupling means for coupling the housing with a housing of the paired terminal pin holding block thereby to allow the contact pin to mate with the contact pin of the paired terminal pin holding block; and sealing means for preventing the mating portion of the contact pin from being exposed to the surrounding air when the paired housings are coupled together.

BRIEF DESCRIPTION OF THE DRAWING

Other objects and advantages of the present invention will become apparent from the following description when taken in conjunction with the accompanying drawings, in which.

DETAILED DESCRIPTION OF A PREFERRED EMBODIMENT

Figure 1:
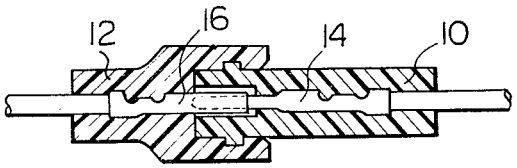
Fig. 1 PRIOR ART
FIGS. 1 to 3 are sectional views of three conventionally used waterproof electric connectors.
Figure 2:
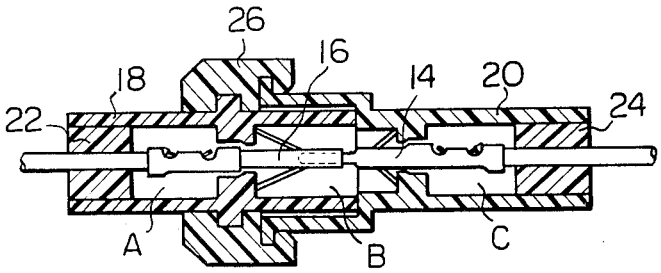
Fig. 2 PRIOR ART
Figure 3:
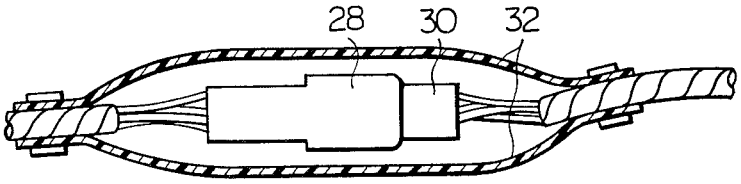
Fig. 3 PRIOR ART

Prior to describing the construction of the waterproof electrical connector of the invention, the prior art waterproof electrical connectors will be outlined with reference to FIGS. 1 to 3 in order to clarify the invention.

In FIG. 1, the first example of the conventional waterproof electrical connector is illustrated. The connector generally comprises matable housings 10 and 12 each being constructed of a soft rubber material, and male and female contact pins 14 and 16 respectively held in the housings 10 and 12. These contact pins mate with each other to provide electrical connections therebetween upon coupling of these housings 10 and 12.

In FIG. 2, the second prior art example is shown, which comprises matable housings 18 and 20 constructed of rigid plastics, male and female contact pins 14 and 16 respectively held in the housings 20 and 18, inner sealing members 22 and 24 of rubber material disposed in the respective housings 18 and 20, and a coupling sleeve 26 of rubber material disposed about the housing 18 to connect the male pin holding housing 20 to the female pin holding housing 18.

In FIG. 3, the third prior art example is shown. This connector generally comprises matable male and female pin holding housings 28 and 30 which may not be of a waterproof type, and a waterproofing bag 32 covering the housings 28 and 30.

The conventional connectors mentioned above however suffer from various disadvantages. For example, in case of the example of FIG. 1, the coupling of the housings 10 and 12 is difficult because of flexibility of the housings. The example of FIG. 2 may solve the above-mentioned trouble because of using the rigid housings 18 and 20. However, as is shown, considerable amount of spaces, A, B and C are sometimes formed inevitably in the connector, so that the pins 14 and 16 exposed to the spaces tend to rust by existence of moisture in the spaces. As is obvious, rusted pins will not operate properly. Although the example of FIG. 3 may solve the problem encountered in the connector of FIG. 2, it becomes bulky and requires considerable numbers of steps in assembling the connector.

Accordingly, the present invention proposes to solve the problems encountered in the above-mentioned conventional waterproof connectors.

Figure 4:
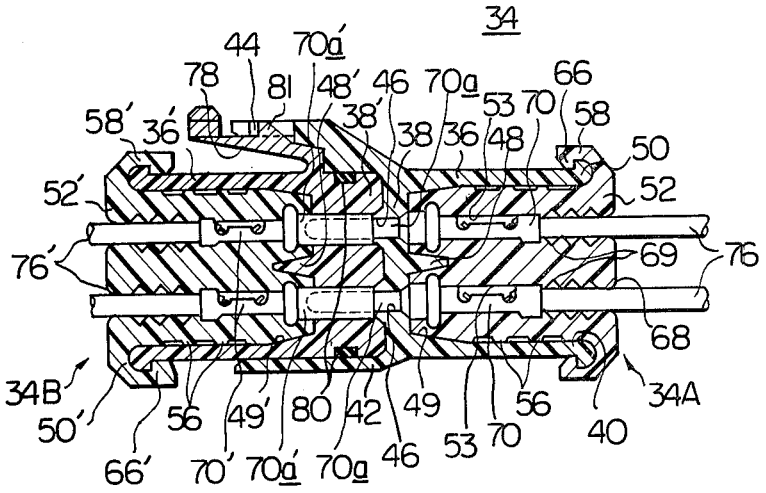
FIG. 4 is a sectional view of a waterproof electric connector according to the present invention.
Figure 7:
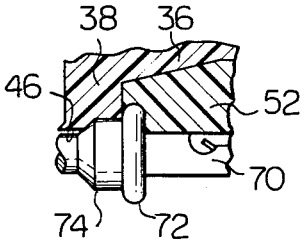
FIGS. 7 and 8 are partial sectional views of a particular portion incorporating a partition wall, a contact pin and a plug member, and show other embodiments.

Referring to FIGS. 4 and 7, especially FIG. 4, there is illustrated a connector 34 of the present invention, being shown in an assembled condition. The connector 34 generally comprises a male pin holding block 34A and a female pin holding block 34B which are coupled together to provide electrical connections therebetween. Each block is designed and constructed to contain therein a plurality of contact pins, four in the embodiment hereinshown.

The male pin holding block 34A comprises a tubular housing 36 constructed of a rigid nonconductive material such as plastics. The housing 36 has a chamber which is closed at left end by a partition wall 38 and open at a right end 40 and has a tubular sleeve 42 coaxially extending leftwards, in FIG. 4, from the partition wall 38 of the housing 36. For the reason which will become apparent hereinafter, the sleeve 42 is formed with an opening 44 at the leading end portion thereof. The partition wall 38 of the housing 36 is formed with four holes 46 which are symmetrically arranged with respect to the center axis of the housing 36 at evenly spaced intervals as will be clear from FIG. 5A. A projection 48 with a pointed end is formed on the inside surface of the partition wall 38 at the position through which the center axis of the housing 36 passes. As is indicated by numeral 49, the inside diameter of the tubular housing 36 decreases regularly towards the partition wall 38 from the generally middle portion of the housing 36. The housing 36 is formed at its right end with a radially outwardly projected circular flange 50 coaxial therewith. As will be seen in FIG. 5A, a projection 51 is formed on the inner wall of the housing 36 for the reason as will be described herein next.

Within the tubular housing 36 is snugly and sealingly received a plug member 52 made of resilient elastomeric material such as rubber material. The plug member 52 is formed with longitudinally extending through holes 53 which are respectively in alignment with the beforementioned holes 46 of the partition wall 38 upon fitting of the plug member 52 in the housing 36, in each of which is received a male contact pin 70 in a manner as will be described hereinafter. The plug member 52, as will be seen from FIG. 5A, comprises a cylindrical body portion 54 having thereon coaxial annular ribs 56 integral therewith, and a folded back portion 58 formed on the top of the cylindrical body portion 54.

The cylindrical body portion 54 is formed with a longitudinally extending recess or groove 60 which is adapted to receive therein the aforementioned projection 51 upon insertion of the plug member 52 into the housing 36. Although not shown in the drawings, such groove 60 and projections 51 may be formed in and on the housing 36 and the plug member 52 respectively so long as, upon coupling therebetween, relative rotation between the plug member 52 and the housing 36 is assuredly prevented by them. Thus, a modification shown in FIG. 5B may be available as a substitute for the type of FIG. 5A, which comprises a projection 62 formed on the outer surface near a folded back portion 58, and a cut 64 formed in the circular flange 50 on the housing 36. Upon tight fitting therebetween, the projection 62 is received in the cut 64.

The folded back portion 58 of the plug member 52 is formed with a radially inwardly projected circular ridge 66 (see FIG. 4) which is coaxial with the cylindrical body portion 54 and is brought into locking engagement with the aforementioned circular flange 50 of the housing 36 upon connection therebetween.

The male contact pins 70 are snugly and sealingly received in the through holes 53 of the plug member 52 in such a manner that the pins or mating portions 70*a* thereof are considerably projected outwards from the plug member 52. Each of the mating portions 70*a* has enough length to project outwards, that is leftwards in FIG. 4, from the partition wall 38 upon fitting of the plug member 52 in the housing 36, as is understood from FIG. 4. Each of the through holes 53 is chamfered at the entrance portion 68 thereof and provided at the right section thereof with axially spaced annular cut out portions 69 for facilitating insertion of the contact pins 70 into the corresponding through holes 53 of the plug member 52.

Figure 6:
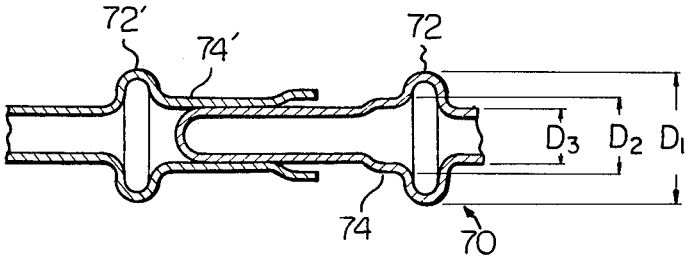
FIG. 6 is a partial, sectional view of male and female contact pins being mated, which are used in the connector of the invention.

As is seen in FIG. 6, the contact pin 70 is formed at the middle thereof with first and second annular enlarged portions 72 and 74 having diameters $D_1$ and $D_2$, respectively, which are to be immersed in the plug member 52. The diameter $D_2$ of the second annular enlarged portion 74 is smaller than $D_1$ of the first annular enlarged portion 72 but greater than $D_3$ of a wire holding portion (no numeral) to which a lead wire 76 is connected. Such formation of the contact pins 70 will not only facilitate the insertion of the pins 70 into the corresponding through holes 53 of the plug member 52 but also assure the tight fitting of the pins 52 in the through holes 53.

Now, it should be noted that upon the final fitting of the plug member 52 in the housing 36, the left end portion of the plug member 52 where the enlarged portions 72 and 74 of the contact pins 70 are located is compressed considerably because of the existence of the decreased section 49 of the chamber of the housing 36 and the projection 48 of the housing 36, the projection 48 sticking in the plug member 52. Thus, the contact pins 70 are tightly gripped or grasped by the plug member 52 under such condition.

Figure 8:
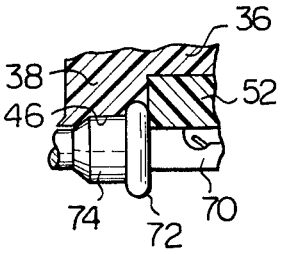

FIGS. 7 and 8 are partial sectional views showing particular portions of other embodiments of the present invention. In the embodiment of FIG. 7, the second annular enlarged portion 74 of the contact pin 70 is positioned in the corresponding hole 46 of the partition wall 38 and the first annular enlarged portion 72 is kept immersed in the plug member 52 upon the final fitting of the plug member 52 with respect to the housing 36. In the embodiment of FIG. 8, both the first and second annular enlarged portions 72 and 74 are positioned in the corresponding hole 46 of the partition wall 38 upon such fitting.

The female pin holding block 34B has generally the same construction and parts as the aforementioned male pin holding block 34A. Thus, for facilitation of the description, the following explanation of the female pin holding block 34B will be made only with respect to parts which are different from those of the male pin holding block 34A, and for ease of understanding and description, parts which are substantially the same in construction and configuration as those of the male pin holding block 34A will be indicated by the addition of the mark "′" after each numeral.

Figure 5B:
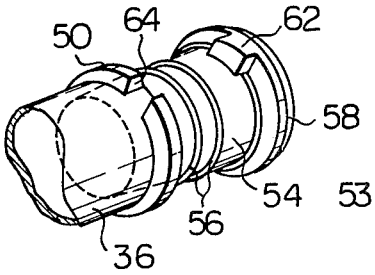
FIG. 5B is a perspective view of a particular portion including a housing and a plug member, but shows a modification of those in FIG. 5A.
Figure 5A:
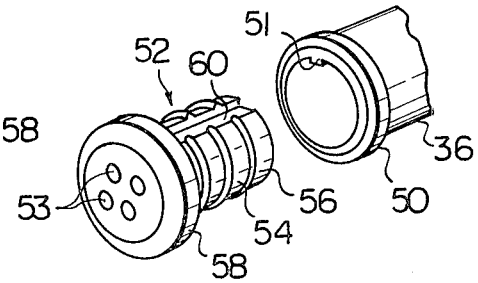
FIG. 5A is an exploded perspective view of a particular portion including a housing and a plug member.

As is shown in FIG. 4, the female pin portion is denoted by numeral 70*a*′ and a housing 36′ of the female pin holding block 34B has an arm 78 which extends leftwards from the right portion of the housing 36′. The arm 78 is formed at the middle thereof with a projection 81 which is to be snapped into the aforementioned opening 44 of the tubular sleeve 42 of the housing 36 for connection between these two housings 36 and 36′. An O-ring 80 of resilient material such as rubber material is disposed about the right tubular portion or base portion of the housing 36'. Of course, substantially the same modifications as in the case of the male pin holding block 34A with respect to FIGS. 5B, 7 and 8 are available in this female pin holding block 34B.

Upon coupling of the male and female pin holding blocks 34A and 34B, the base or partition portion 38' of the housing 36' is inserted into the sleeve 42 of the housing 36. Under such insertion, the arm 78 of the housing 36' is depressed downwardly due to engagement between the projection 81 and the leading end of the sleeve 42. When the projection 81 moves over the leading end of the sleeve 42, the projection 81 falls in the opening 44 of the sleeve 42 to lock the housings 36 and 36' together. With such insertion, the male pin portions 70*a* of the housing 36 enter the female pin portions 70*a*' of the housing 36', thus coupling male and female contact pins 70 and 70' together and providing for a continuous electrical connection between the male and female pin holding blocks 34A and 34B. If it is desired to disconnect the blocks 34A and 34B, the housing 36' is pulled away from the housing 36, depressing the arm 78 downwardly.

It will be observed when considering the preceding description that the insertion of the plug member 52 or 52' into the corresponding housing 36 or 36' requires little effort because of the existance of the ribs 56 or 56' of the plug member. But, once the plug member 52 or 52' is finally fitted in the housing and the folded back portion thereof 58 or 58' is latched with the circular ridge 50 or 50' of the housing, the plug member is firmly locked in place in the housing while tightly gripping the contact pins 70 and 70'. Furthermore, since the contact pins 70 and 70' are sealingly enclosed by the plug member 52 or 52' and the male and female pin portions 70*a* and 70*a*' are also sealingly enclosed by the housings 36 and 36', more particularly by the partition wall 38 of the housing 36 and the base portion 38' of the housing 36' upon coupling of the blocks 34A and 34B, a fear of the contact pins 70 and 70' to rust in operational usage will be substantially eliminated.

It is to be understood that the aforementioned embodiments of the invention are merely illustrative. Numerous modifications may be made by those skilled in the art without departing from the spirit and scope of the invention.

What is claimed is:

1. A waterproof electric connector comprising a pair of terminal pin holding blocks which can be coupled together to provide electrical connection therebetween, each of said blocks comprising:

a housing having a chamber which is closed at one end by a partition wall and open at the other end, said partition wall being formed with at least one opening;

a plug member of resilient elastomeric material sealingly but removably disposed in said chamber of said housing, said plug member being formed with a through hole which is aligned with said opening upon final fitting of said plug member in said chamber;

a contact pin sealingly but removably disposed in said through hole of said plug member in a manner that at least a section of said contact pin is placed in said opening of said partition wall, said contact pin having at the section thereof a mating portion matable with a mating portion of a contact pin of the paired terminal pin holding block;

locking means for locking said plug member and said housing together, said locking means including a flange portion formed about said housing at the open end of the same, and a folded back portion formed about one end of said plug member, said folded back portion enclosing said flange portion upon final fitting of said plug member in said housing thereby to accomplish locking engagement between said plug member and said housing;

coupling means for coupling said housing with a housing of the paired terminal pin holding block thereby to allow said contact pin to mate with the contact pin of the paired terminal pin holding block; and sealing means for preventing said mating portion of said contact pin from being exposed to the surrounding air when the paired housing are coupled together.

2. A waterproof electric connector as claimed in claim 1, in which an inner surface of said partition wall is entirely in contact with an edge of said plug member upon final fitting of said plug member in said chamber of the housing.

3. A waterproof electric connector as claimed in claim 2, in which said plug member is formed thereabout with a plurality of spaced ribs so that insertion of said plug member into said chamber of the housing from the open end of the same is facilitated.

4. A waterproof electric connector as claimed in claim 3, in which the cross-sectional area of said chamber decreases regularly towards said partition wall from the generally middle portion of said chamber.

5. A waterproof electric connector as claimed in claim 4, in which said partition wall is formed with a projection having a pointed end, said projection sticking in said plug member when said plug member is finally fitted in said chamber of the housing.

6. A waterproof electric connector as claimed in claim 5, in which said through hole of said plug member is chamfered at the entrance portion thereof from which said contact pin is insertable.

7. A waterproof electric connector as claimed in claim 1, in which said coupling means comprises a sleeve portion extending outwardly from the partition wall, said sleeve portion being adapted to snugly receive therein a portion of the housing of the paired terminal pin holding block.

8. A waterproof electric connector as claimed in claim 1, in which said sealing means comprises an O-ring of elastomeric material which is disposed about an end of said housing.

9. A waterproof electric connector as claimed in claim 1, in which an outer surface of said partition wall is entirely in contact with an outer surface of a partition wall of said paired terminal pin holding block when the blocks are coupled together.

* * * * *